US009135839B2

(12) United States Patent
Remenda

(10) Patent No.: US 9,135,839 B2
(45) Date of Patent: Sep. 15, 2015

(54) SCROLLING BACKLIT DISPLAY WITH SUPERIMPOSED BACKGROUND AND FOREGOING GRAPHICS, MULTI-COLOR LED BACKLIT PANEL, AND ILLUMINATED HOUSING

(71) Applicant: Tobin Remenda, Calgary (CA)

(72) Inventor: Tobin Remenda, Calgary (CA)

( * ) Notice: Subject to any disclaimer, the term of this patent is extended or adjusted under 35 U.S.C. 154(b) by 0 days.

(21) Appl. No.: 14/462,723

(22) Filed: Aug. 19, 2014

(65) Prior Publication Data

US 2015/0059219 A1 Mar. 5, 2015

Related U.S. Application Data

(60) Provisional application No. 61/870,993, filed on Aug. 28, 2013.

(51) Int. Cl.

| | |
|---|---|
| ***G09F 11/21*** | (2006.01) |
| ***G09F 13/04*** | (2006.01) |
| ***G09F 13/18*** | (2006.01) |
| ***G09F 13/22*** | (2006.01) |
| ***G09F 11/02*** | (2006.01) |

(52) U.S. Cl.

CPC ..... *G09F 11/21* (2013.01); *G09F 11/02* (2013.01); *G09F 13/04* (2013.01); *G09F 13/18* (2013.01); *G09F 13/22* (2013.01); *G09F 2013/222* (2013.01)

(58) Field of Classification Search

CPC ..... G09F 11/29; G09F 11/18; G09F 13/18; G09F 2013/1831; G09F 2013/1836; G09F 2013/1881; G02B 6/0091

See application file for complete search history.

(56) References Cited

U.S. PATENT DOCUMENTS

| | | | | |
|---|---|---|---|---|
| 2,727,327 | A * | 12/1955 | Colby | 40/546 |
| 4,104,810 | A * | 8/1978 | Mirman | 434/73 |
| 4,434,568 | A | 3/1984 | Guerrero | |
| 5,138,783 | A * | 8/1992 | Forsse | 40/546 |
| 5,412,892 | A | 5/1995 | Filippakis | |
| 5,423,140 | A * | 6/1995 | Nuspl | 40/518 |
| 5,695,346 | A | 12/1997 | Sekiguchki et al. | |
| 5,809,677 | A * | 9/1998 | Wamser et al. | 40/471 |
| 7,024,809 | B1 * | 4/2006 | Poma | 40/546 |
| 7,220,019 | B2 | 5/2007 | Cheung et al. | |
| 7,559,668 | B1 * | 7/2009 | Aubrey | 362/140 |
| 8,496,371 | B2 * | 7/2013 | Chang et al. | 362/629 |

(Continued)

FOREIGN PATENT DOCUMENTS

| | | |
|---|---|---|
| CA | 2284405 | 3/2001 |
| CA | 2312682 | 4/2001 |

*Primary Examiner* — Gary Hoge

(74) *Attorney, Agent, or Firm* — Kyle R. Satterthwaite; Ryan W. Dupuis; Ade & Company Inc.

(57) ABSTRACT

A unique scrolling backlit display used for advertising or the like features two sets of spools carrying separate webs thereon that respectively contain background and foreground imagery, whereby scrolling of one web relative the other increases the number of distinct visuals that can be attained with the device, and also allows dynamic animation-like displays in which foreground images change over a maintained background, or vice-versa. Multi-color LED light sources in the backlighting device are operable to create vibrant, dynamic lighting effects, while illumination of the display housing further increases the visual appeal of the display.

12 Claims, 7 Drawing Sheets

(56) References Cited

U.S. PATENT DOCUMENTS

| | | | | |
|---|---|---|---|---|
| 2004/0004827 | A1 | 1/2004 | Guest | |
| 2006/0107568 | A1 | 5/2006 | Nicholini et al. | |
| 2006/0150452 | A1 * | 7/2006 | Chen | 40/471 |
| 2006/0291241 | A1 * | 12/2006 | Wojtowicz et al. | 362/604 |
| 2009/0100727 | A1 * | 4/2009 | Chen | 40/546 |
| 2010/0107461 | A1 * | 5/2010 | Carter | 40/514 |
| 2011/0285299 | A1 * | 11/2011 | Kinderman et al. | 315/192 |
| 2014/0007474 | A1 * | 1/2014 | Varveris | 40/544 |

* cited by examiner

FORWARD
BACKARD
16
30a
22b
32a
22c
26
20
28a
42
22a
22
14
18
24
44
64
66
46
40
28
22b
32b
28b
44
16

BACKGRD
20
22a
22b
22c
26
28a
28b
30a
30b
34a
34b
36a
36b
38a
38b
40a
40b
42
14
16
18
24
64
66

SCROLLING BACKLIT DISPLAY WITH SUPERIMPOSED BACKGROUND AND FOREGOING GRAPHICS, MULTI-COLOR LED BACKLIT PANEL, AND ILLUMINATED HOUSING

CROSS REFERENCE TO RELATED APPLICATIONS

This application claims benefit under 35 U.S.C. 119(e) of Provisional Application Ser. No. 61/870,993, filed Aug. 28, 2013, the entirety of which is incorporated herein by reference.

FIELD OF THE INVENTION

The present invention relates to scrolling-type displays used for advertising or the like, and more particularly to a unique display using multiple scrolling webs to superimpose background and foreground images over a backlit panel which uses multi-color LED light sources to provide various vibrant and attractive illumination options.

BACKGROUND OF THE INVENTION

Backlit displays using graphics (e.g. images, alphanumeric text, other indicia and combinations thereof) displayed on a sheet or web positioned over an illumination source are known for advertising and other information-conveying or display purposes.

Some such displays employ a single fixed and stationary image, while others employ a scrolling configuration in which multiple graphic displays or frames are presented on a flexible web or sheet entrained about a set of rollers, whereby manual or powered rotation of the rollers can be used to change which graphic display or frame is displayed in the span of the web or sheet between the rollers.

Examples of stationary image backlit displays can be found in U.S. Pat. No. 7,220,019 and U.S. Patent Application Publications 2004/0004827 2006/0107568. Scrolling image backlit displays can be found in U.S. Pat. No. 5,412,892 U.S. Patent Application Publications 2010/0107461.

In the forgoing prior art, even where a scrolling web is used to allow display of different graphics at different times without swapping out the display sheet or web, they can only be display one at a time. Thus, the only way to display two different graphics that share common backdrop or background elements is to print the two such graphics on the same web, and have the device scroll from one graphic to the other. Also, of the above references, only U.S. Pat. No. 7,220,019 uses color LED's to illuminate the display, and provides limited description of possible color effects achievable by same.

U.S. Pat. Nos. 4,104,810 and 4,434,568 teach scrolling displays that employ multiple scrolling elements to allow variation of the graphic display by superimposing elements of one scrolling element over an underlying scrolling element. The displays are not backlit and thus cannot provide the same vibrant effect as a backlit display, and the particular scroll configurations shown are not suitable for mere addition of a backlight device according to conventional backlit displays.

Display devices of other types less relevant to the present invention are also known, for example including displays that employ lenticular lenses to create the appearance of a changing image, as disclosed in U.S. Pat. No. 5,695,346 and Canadian Patent Applications 2284405 and 2312683. However, such prior art provides no hint of how to address the aforementioned shortcomings of the prior art in for scrolling, backlit displays.

Accordingly, there remains room for improvement in the field of scrolling and backlit displays.

SUMMARY OF THE INVENTION

According to a first aspect of the invention there is provided a scroll type display device comprising:

a frame;

a first pair of spools supported on the frame and spaced apart from one another;

a second pair of spools supported on the frame and spaced apart from one another;

a flexible background web having background graphics thereon and being entrained about the first pair of spools to span therebetween for scrolling of said flexible background web between said first pair of spools under rotation of at least one of said first pair of spools;

a flexible foreground web having foreground graphics thereon and being entrained about the second pair of spools for scrolling of said flexible foreground web between said second pair of spools in a position overlying the span of the flexible background web between the first pair of spools under rotation of at least one of said second pair of spools;

a first drive mechanism operable to drive rotation of said at least one of said first pair of spools;

a second drive mechanism operable to drive rotation of said at least one of said second pair of spools; and a backlight device supported on the frame to underlie the span of the flexible background web between the first pair of spools on a side of said flexible background web opposite the flexible foreground web.

Preferably the frame comprises a display border delimiting a viewing window through which the foreground web is viewable, each pair of spools being spaced apart across said viewing window so that each web spans fully across said viewing window.

Preferably the viewing border comprises at least one translucent portion, and there is provided an illumination source positioned on the frame to illuminate said translucent portion of the viewing border.

Preferably the backlight device comprises an illumination panel spanning an area of the viewing window, and the frame further comprises an auxiliary window positioned opposite the viewing window and through which the light from the illumination panel is visible.

Preferably the display border comprises front and rear shells coupled together with a hollow space therebetween in which the scrolls and the drive mechanisms are supported, wherein the front shell defines the viewing window and the rear shell defines the auxiliary window.

Preferably the backlight device comprises an edge-lit panel illuminated by multiple light sources disposed around a perimeter of said edge-lit panel to emit light into said panel from perimeter edges thereof.

Preferably the multiple light sources comprise LED light sources.

Preferably the LED light sources are multi-color LED light sources operable to emit different colors of light, and an LED controller operable to control said colors of light.

Preferably the LED controller is operable to control said multi-color LED light sources in a manner simultaneously illuminating different areas of the edge-lit panel in different colors.

Preferably the multi-color LED light sources comprise LED strips spanning different portions of the perimeter of the edge-lit panel.

Preferably the LED controller is operable to flip at least one of said multi-color LED's back and forth between two different colors.

According to a second aspect of the invention there is provided a scroll type display device comprising:

a frame;

a pair of spools supported on the frame and spaced apart from one another;

a flexible web having graphics thereon and being entrained about the pair of spools to span therebetween for scrolling of said flexible web between said first pair of spools under rotation of at least one of said pair of spools;

a drive mechanism operable to drive rotation of said at least one of said pair of spools;

an illumination panel supported on the frame to underlie the span of the flexible web between the pair of spools, the illumination panel comprising a plurality of multi-color light sources distributed at different positions to illuminate different portions of said illumination panel; and an illumination controller operable to vary an illumination pattern of the illumination panel by switching a color of light at one or more said different positions.

Preferably said illumination controller is linked to a drive controller operable to control the drive mechanism, and the controllers are arranged so that scrolling of flexible web from one position to another to change a display shown at the span of the flexible web between the spools corresponds to a respective automatic change of the illumination pattern of the illumination panel.

According to a third aspect of the invention there is provided a scroll type display device comprising:

a frame;

a pair of spools supported on the frame and spaced apart from one another;

a flexible web having imagery or indicia thereon and being entrained about the pair of spools to span therebetween for scrolling of said flexible web between said first pair of spools under rotation of at least one of said pair of spools;

a drive mechanism operable to drive rotation of said at least one of said pair of spools;

an illumination panel supported on the frame to underlie the span of the flexible web between the pair of spools, the illumination panel comprising a plurality of multi-color light sources each operable to emit different colors of light to change an illuminated state of the illumination panel;

a control system operable to control the multi-color light sources and the drive mechanism, the control mechanism being configured such that scrolling of flexible web from one position to another to change a display shown at the span of the flexible web between the spools corresponds to a respective automatic change in the illuminated state of the illumination panel.

According to a fourth aspect of the invention there is provided a method of varying a display shown by a scrolling type display device having a pair of spools, a flexible web having graphics thereon and being entrained about the pair of spools to span and scroll therebetween, a drive mechanism and an illumination panel underlying the span of the flexible web between the pair of spools, the method comprising automatically changing an illuminated state of the illumination panel in concert with operation of the drive mechanism scroll of flexible web from one position to another to change a graphic shown at the span of the flexible web.

Changing the illuminated state of the illumination panel may comprise changing a color in which the entire panel is illuminated.

Alternatively, changing the illuminated state of the illumination panel comprises changing an illumination pattern of the illumination panel by changing a color emitted by at least one of a plurality a multi-color light sources each arranged to illuminate a different respective portion of the illumination panel.

According to a fifth aspect of the invention there is provided a backlit display device comprising a frame supporting a backlight panel, a sheet or web supported in a position overlying the backlight panel and having one or more graphics on the sheet or web for illumination by the backlight panel, and a housing closing around the backlight panel and the sheet or web and delimiting a viewing window through which the sheet or web is visible, wherein the housing comprises at least one translucent portion and contains an additional illumination source arranged to illuminate said translucent portion of the housing.

According to a sixth aspect of the invention there is provided a method of producing a housing for a backlit display, the method comprising forming one or more housing elements of a transparent or translucent material, and surface treating at least a partial area of the one or more housing elements to reduce transparency of said area for concealment of internal components of the backlit display while retaining a degree of transparency or translucency greater than said area of reduced transparency at one or more other areas to allow light transmission through said one or more other areas for provide a glowing effect to said housing.

Preferably the step of forming one or more housing elements comprises molding said one or more housing elements from a plastic material.

Preferably the step of forming one or more housing elements comprises molding said one or more housing elements from Lexan™ polycarbonate.

Preferably the step of surface treating the area of the one or more housing elements comprises sandblasting said area.

BRIEF DESCRIPTION OF THE DRAWINGS

In the accompanying drawings, which illustrate exemplary embodiments of the present invention.

DETAILED DESCRIPTION

Figure 1:
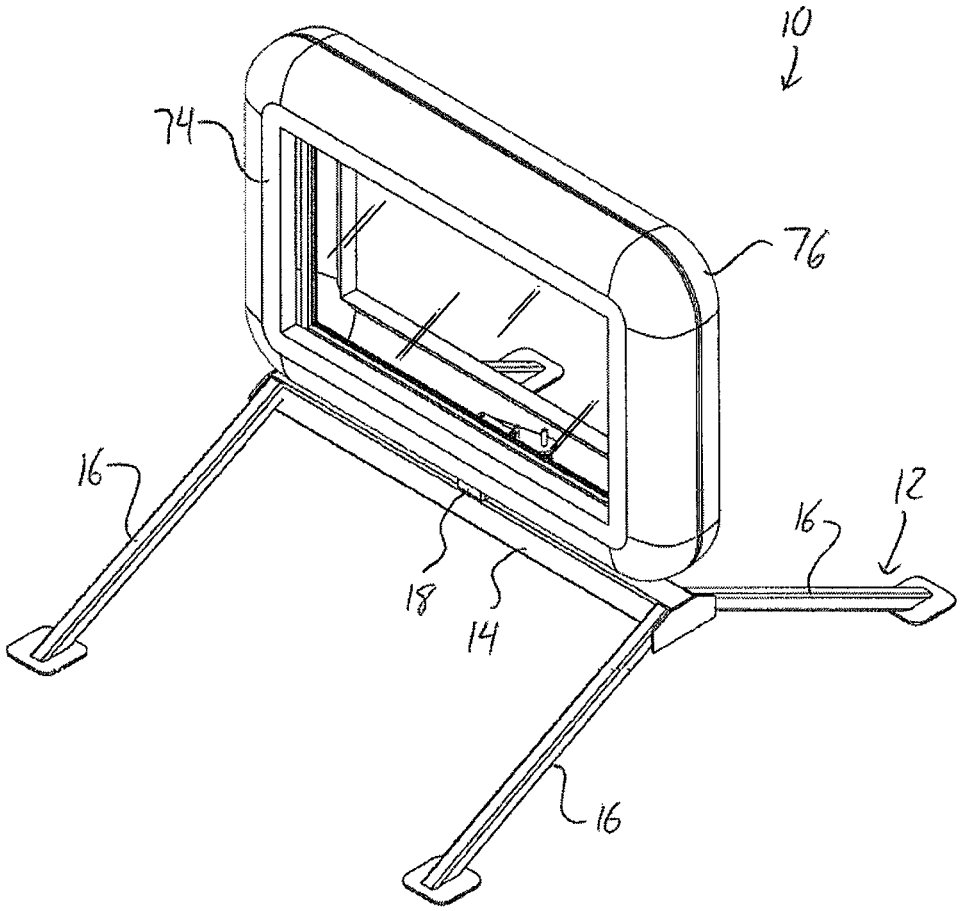
FIG. 1 is a front perspective view of a backlit, scrolling display device according to the present invention, with scrolling foreground and background images omitted for ease of illustration.

FIG. 1 shows a scrolling display device 10 of the present invention. A base frame 12 features a main cross-beam 14 supported horizontally at a short elevation above ground by four legs 16 sloping obliquely downward therefrom in two matching pairs, each of which features two downwardly diverging legs extending from opposite sides of the cross-beam at a respective end thereof. A central pedestal or stanchion 18 stands vertically upright from the cross-beam 12 at a central position therealong, halfway between the two pairs of legs 14.

Figure 2:
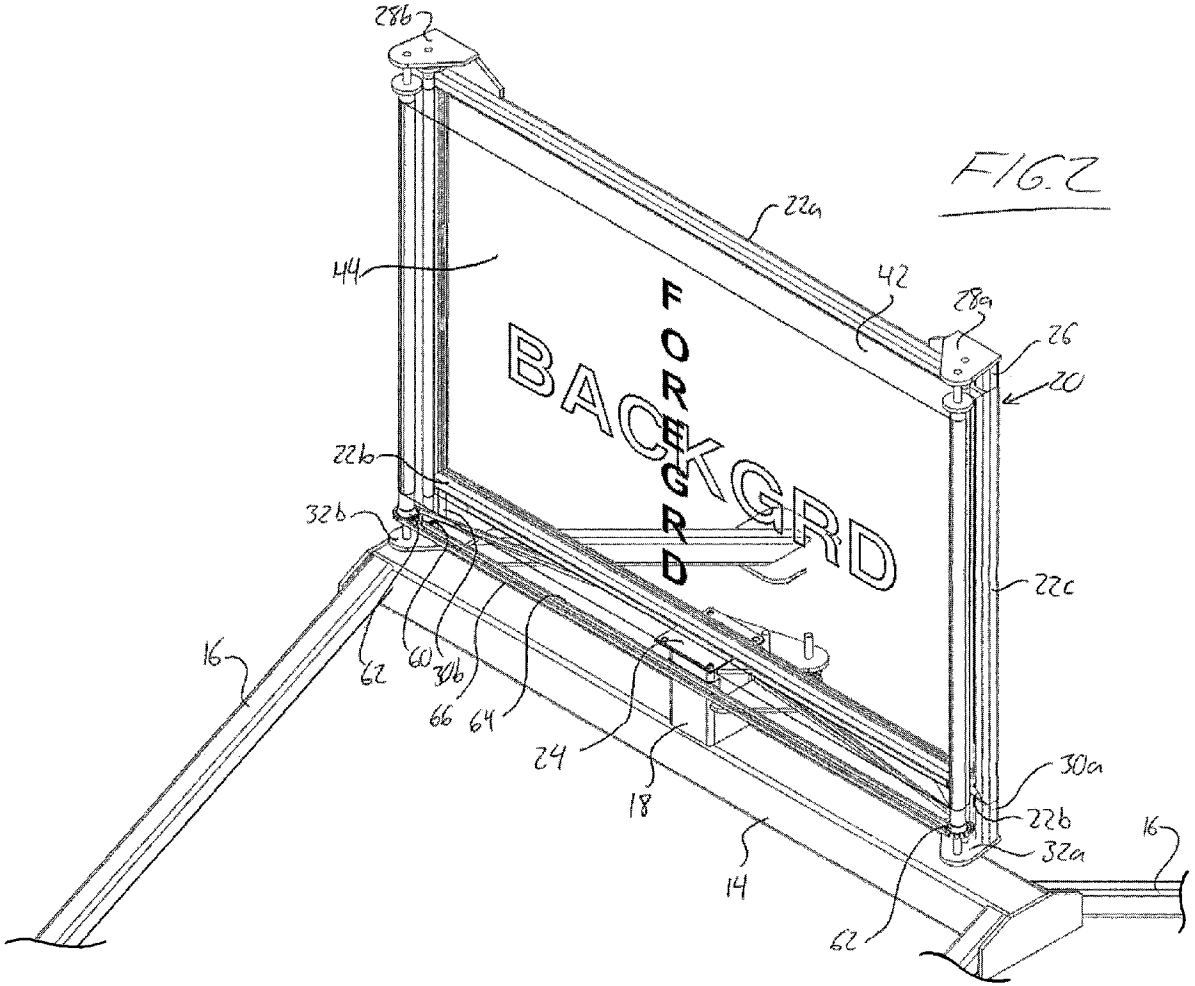
FIG. 2 is a partial front perspective view of the scrolling display device of FIG. 1 with a display border thereof omitted to show internal components mounted therein, and schematically showing foreground and background images presented on separately scrollable foreground and background webs that overlie on another in front of a backlight illumination panel.
Figure 3:
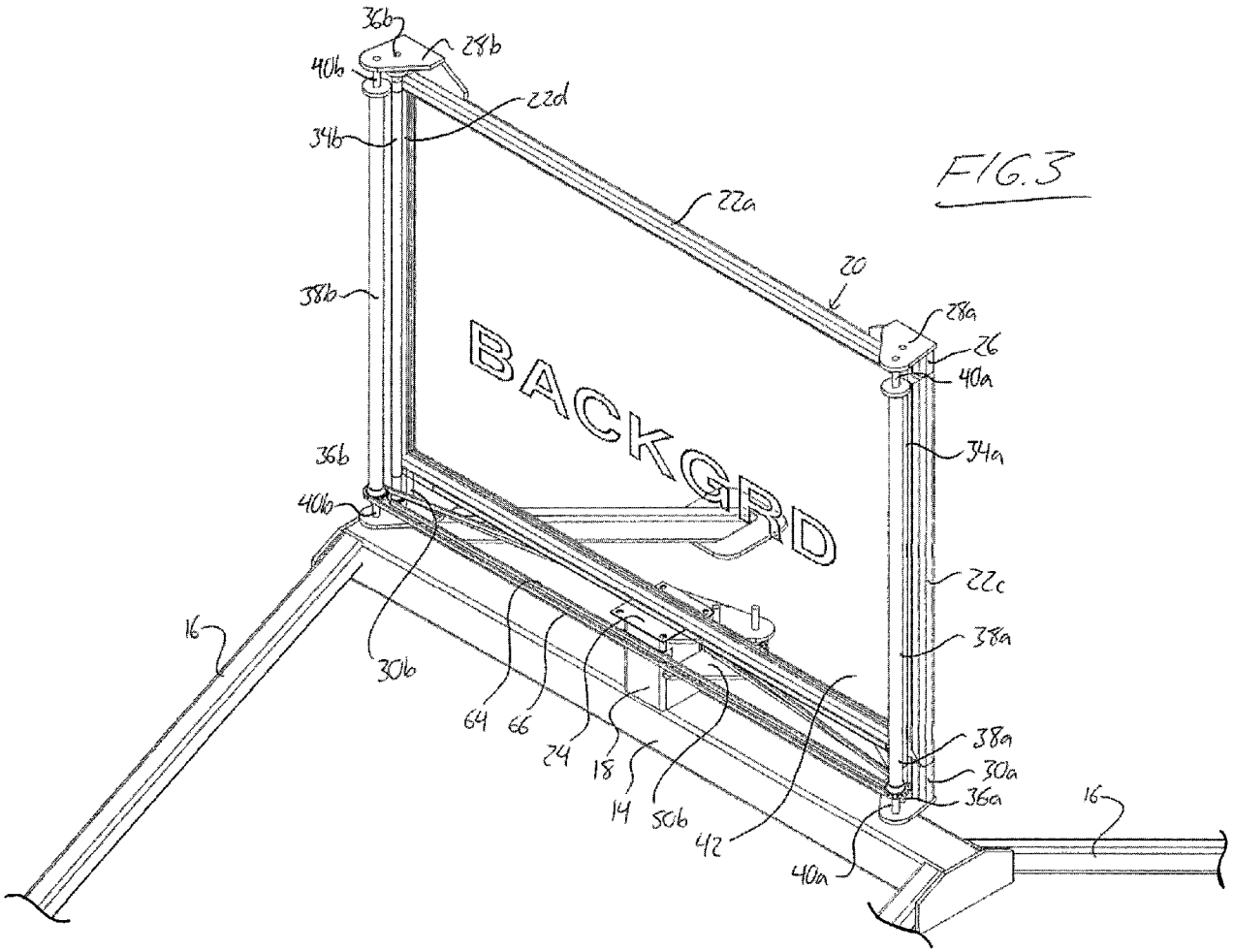
FIG. 3 is a partial front perspective view of the scrolling display device of FIG. 2 with the foreground web also omitted.

Turning to FIG. 2, a display frame 20 mounted atop the pedestal 18 features four elongated frame members welded or otherwise fastened together at ends of the frame members to form a closed rectangular frame residing in a same vertical plane as the main cross-beam 14. Horizontal top and bottom frame members 22*a*, 22*b* lie parallel to the main cross-beam 14, with the bottom frame member mounted atop a horizontal mounting plate 24 fixed to the top end of the pedestal 18. Parallel side members 22*c*, 22*d* of the display frame vertically interconnect the top and bottom frame members 22*a*, 22*b* at respective ends thereof. In the illustrated embodiment, the main cross-beam, legs and pedestal of the base frame and the top, bottom and side frame members of the display frame are formed of rectangular metal tubing, but members of other shapes and materials may alternatively be used.

Two top extensions 26 each continue upwardly inline with a respective one of the side frame members 22*c*, 22*d* of the display frame 20 past the horizontal top frame member 22*a* to carry a respective top bracket 28*a*, 28*b* that projects horizontally forward beyond the rectangular display frame 20. In the same manner, two bottom extensions 30*a*, 30*b* each continue downwardly inline with a respective one of the side frame members 22*c*, 22*d* of the display frame 20 past the horizontal bottom frame member 22*b* to carry a respective bottom bracket 32*a*, 32*b* that projects horizontally forward beyond the rectangular display frame 20 and aligns with a respective one of the top brackets 28*a*, 28*b*.

A first pair of spools 34*a*, 34*b* are fixed on respective vertical shafts 36*a*, 36*b* each having its top and bottom ends rotatably supported by a respective pair of the top and bottom brackets near the where these brackets connect to the rectangular display frame 20 so that these first spools are supported a short distance in front of the side members 22*c*, 22*d* of the rectangular display frame 20 for rotation about respective vertical axes. A second pair of spools 38*a*, 38*b* are fixed on respective vertical shafts 40*a*, 40*b* each having its top and bottom ends rotatably supported by a respective pair of the top and bottom brackets near the distal ends of these brackets furthest from the display frame 20 so that these second spools are supported further in front of the rectangular display frame 20 for rotation about respective vertical axes.

A first flexible web 42 of transparent material has its opposite ends attached to and wound on the spools 34*a*, 34*b* of the first pair to span between these two spools in a planar fashion with sufficient tension to scroll from one spool to the other under rotation of these spools in a common direction. A second flexible web 44 of transparent material has its opposite ends attached to and wound on the spools 38*a*, 38*b* of the second pair to span between these two spools in a planar fashion with sufficient tension to scroll from one spool to the other under rotation of these spools in a common direction. The span of the second web 44 between the second pair of spools thus overlies the span of the first web 42 between the first pair of spools in a parallel manner on a side of the first web opposite the rectangular display frame 20. Each web is unlooped, i.e. not endless, as it has two separate and distinct ends that are attached to the respective spools so that it spans between these spools on only one side thereof.

Graphics are printed on or otherwise applied to each of the webs, and in each case may include images, alphanumeric text, other indicia, or any combination thereof. Viewing the device of the present invention from in front, graphics on the span of the first web 42 with thus form a background to graphics on the span of the second web 44, as schematically illustrated in the drawings by use of the unfilled, block letter abbreviation of the term background, 'BACKGRD', on the first web 42, and the solid letter abbreviation of the term foreground, 'FOREGRD', on the second web 44. As illustrated, portions of the second web span that are unoccupied by the foreground graphic remain transparent, thus allowing viewing of underlying portions of the background graphic on the first web through the transparent area of the second web.

Figure 4:
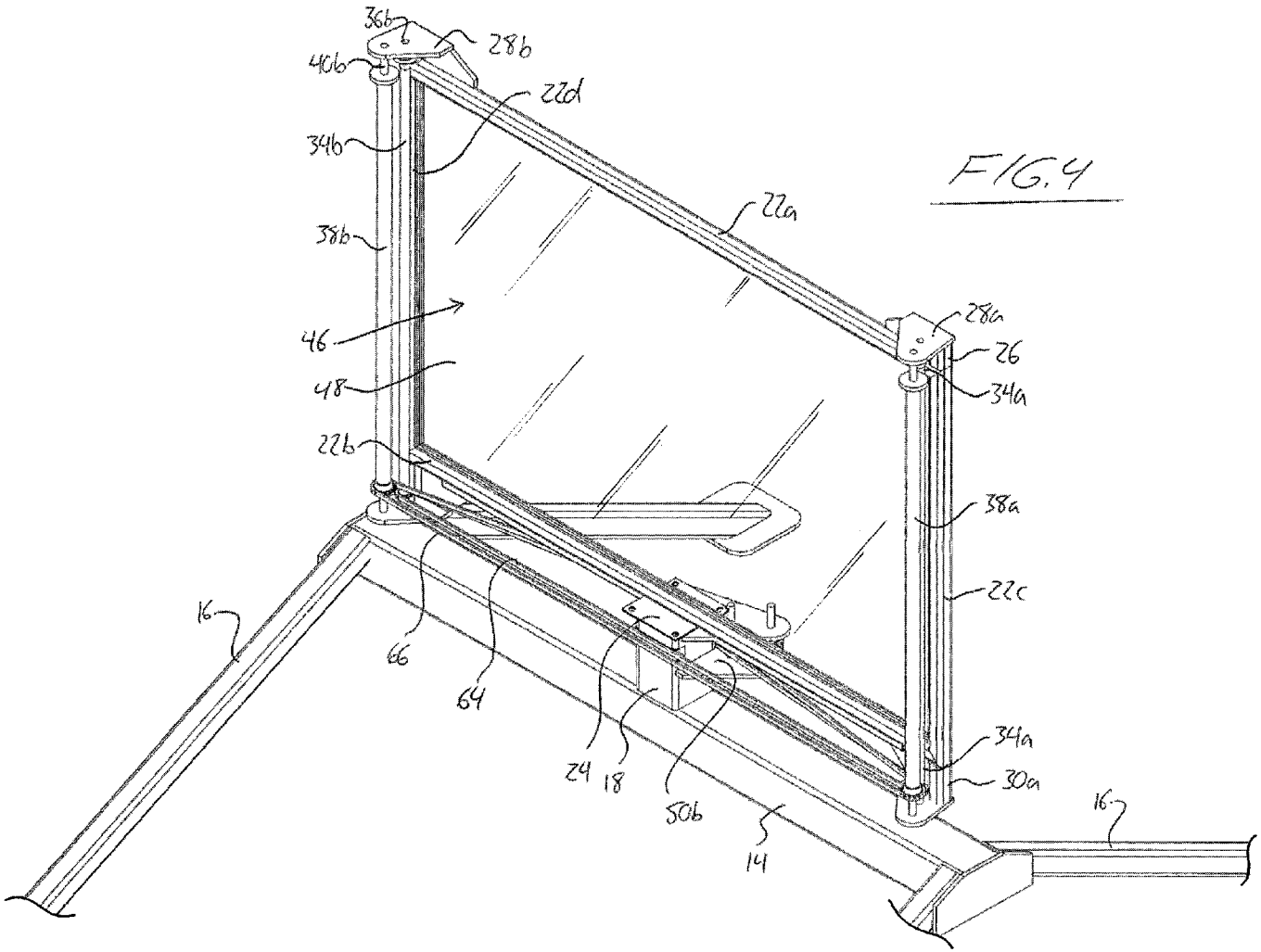
FIG. 4 is a partial front perspective view of the scrolling display device of FIG. 3 with the background web also omitted
Figure 5:
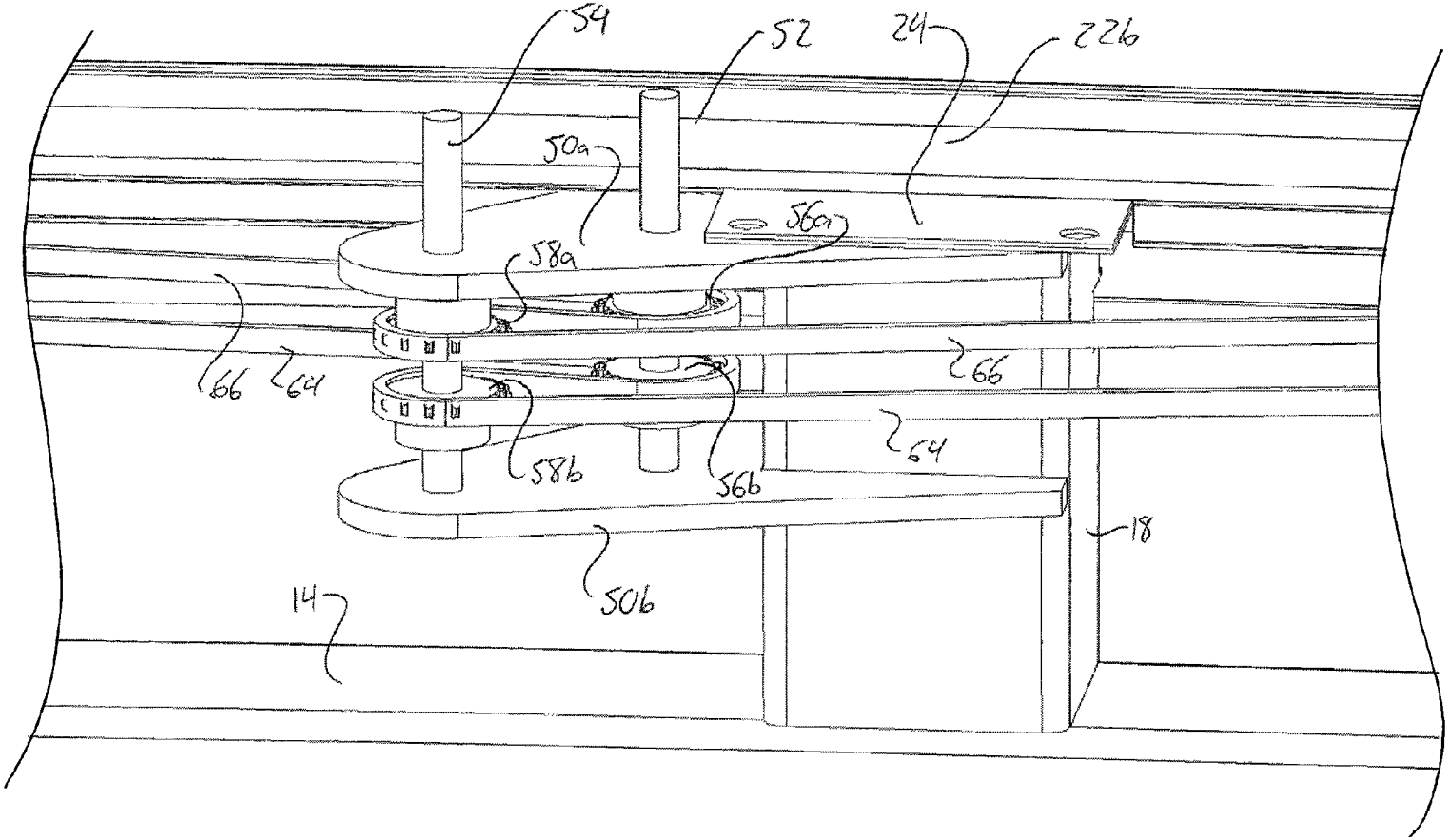
FIG. 5 is a partial close-up rear perspective view of the scrolling display device of FIG. 4 showing components of a drive system for scrolling the foreground and background webs.

With reference to FIG. 4, the members of the rectangular display frame 20 border respective sides a rectangular illumination panel 46, thereby holding the illumination panel 46 in place behind the two web spans for providing backlight functionality to the same. As described in further detail below, the illumination panel is made up of a sheet 48 of light diffusing translucent material, such as Lexan™ polycarbonate, and a plurality of LED light sources arranged to emit light into the sheet to for distribution of light throughout the sheet and casting of this light from the surface area of the sheet through the transparent portions of the first web, and further onward through any transparent portions of the second web overlying the transparent portions of the first web.

Top and bottom drive mounting flanges 50*a*, 50*b* of the same shape project laterally and rearward from the pedestal 18 in a common direction and in alignment with one another at vertically spaced positions. A first stub shaft 52 runs vertically through the flanges 50*a*, 50*b* a short distance behind the rectangular frame 20, and a second stub shaft 54 runs vertically through the flanges further back from the first stub shaft 52, nearer a distal end of the aligned flanges. Between the flanges, each stub shaft carries two sprockets, one positioned above the other. Each stub shaft 52, 54 is rotatable about its axis, and one of its sprockets is fixed to the shaft for rotation therewith, and the other is freely-rotatable relative to the shaft. The fixed sprocket of each shaft corresponds to the free-wheeling sprocket of the other. For the illustrated embodiment, on the first stub shaft 52, the top sprocket 56*a* is fixed and the bottom sprocket 56*b* is free-wheeling, while for the second stub shaft 54, the top sprocket 58*a* is free-wheeling and the bottom sprocket 58*b* is fixed.

The shafts 36*a*, 36*b* of the first pair of spools 34*a*, 34*b* have respective sprockets 60 fixed thereto for rotation therewith at an elevation below the spools near the bottom brackets 32*a*, 32*b*. The shafts 40*a*, 40*b* of the second pair of spools 38*a*, 38*b* have respective sprockets 62 fixed thereto for rotation therewith at an elevation that is below the spools near the bottom brackets 32*a*, 32*b*, and slightly above the sprockets 60 of the first pair of spools. A first drive chain 64 is entrained about the sprockets 60 of the first spool shafts and the matching-elevation bottom sprockets 56*b*, 58*b* of the two stub shafts 52, 54. A second drive chain 66 is entrained about the sprockets 62 of the second spool shafts and the matching-elevation top sprockets 56*a*, 58*a* of the two stub shafts 52, 54. Each chain follows an S-curve in its travel around the sprockets of the stub shafts, and forms a closed loop around the pedestal beneath the rectangular display frame.

Figure 6:
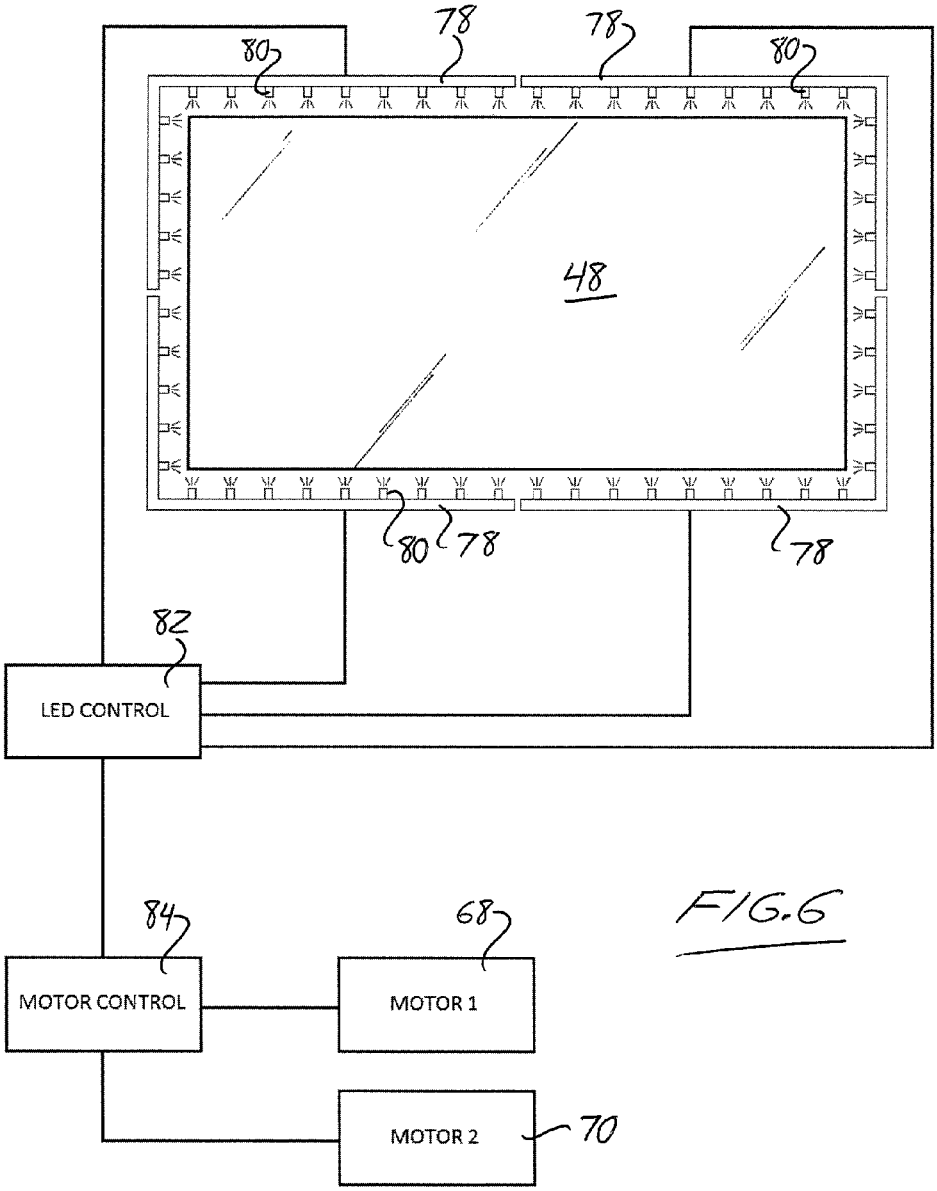
FIG. 6 is a schematic illustration demonstrating assembly of the backlight illumination panel and connection thereof to a control system for operating the backlight illumination panel and the drive system.

Although shown only schematically in FIG. 6, a first motor 68 has its output coupled to the first stub shaft 52, and a second motor 70 has its output coupled to the second stub shaft 54. This way, operation of the first motor 68 drives rotation of the first pair of spools in a direction matching one another, via the first chain 64, and operation of the second motor 70 drives rotation of the second pair of spools in a direction matching one another, via the second chain 66. Each motor is referably operable in both directions, thereby enabling scrolling of the respective web in both directions between the respective pair of spools, thereby maximizing the possible achievable number of the foreground and background combinations through automated control of the motors, and/or allowing automated rewinding of the scrolls after scrolling fully therethrough in a first direction.

Turning back to FIG. 1, a display border 72 is provided by assembly of front and rear shell pieces 74, 76 that fasten together from in front of and behind the rectangular display frame 20. Each shell 74, 76 is in the form of a rectangular ring delimiting a respective viewing window. An outer face of each shell 74, 76 facing away from the other shell is closed, while the mated-together faces of the shells are open so that the coupled-together shells form a hollow interior. The hollow spaces between the uprights sides of the two shells accommodate the side members of the rectangular display frame, the spools on which the foreground and background webs are wound, and the brackets and shafts that support the spools, including the chain-following sprockets near the bottom ends of these shafts. The hollow space between the horizontal upper spans of the two shells accommodates the top frame member 22*a* of the rectangular display frame 20. The hollow space between the horizontal lower spans of the two shells accommodates the bottom frame member 22*b* of the rectangular display frame 20, the two drive chains entrained about the sprockets of the drive system, the mounting plate 24, the drive mounting flanges, the upper portion of the pedestal to which the mounting plate and mounting flanges are fixed, and the stub shafts and associated sprockets and drive motors mounted at the mounting flanges.

The assembled shells 74, 76 thus reveal only the inter-spool planar spans of the background and foreground webs through, and the light diffusing sheet of the illumination panel, and form a housing for all the components situated above the base frame to support and scroll the two webs. The viewing window formed by the front shell 74 forms the primary front viewing window through which the two webs are visible, as backlit by the illumination panel. The viewing window may be open space, or may be closed with a transparent or translucent cover, for example in the form of another sheet of Lexan, to protect the internal components of the device. In the illustrated embodiment where the rear shell also has a window opening, a glow of the illumination panel or a mirror image of that viewable from the front of the device is also viewable from the rear of the device. Other embodiments may feature a closed rear shell, in which case the rear face of the Lexan sheet need not necessarily be uncovered for light transmission therethrough, and for example may have a reflective material applied to redirect all light through the forward face, where it lights up the webs. In another embodiment, a second set of foreground and background scrolls are provided on the rear side of the illumination panel, whereby advertising or other information can be displayed at both the front and rear of the device. The spool content at the front and rear may the same or different. Where the content of the front and rear spools are the same, the displayed content may or may not be matched up in time sequence so as to display the same information front and rear at the same time.

FIG. 6 shows an exploded and schematic illustration of the illumination panel 48, which features the aforementioned Lexan sheet 48 and a plurality of LED strips 78 each comprising a plurality of multi-colored LED clusters 80 mounted at spaced apart positions along the flexible substrate of the strip to provide edge-based illumination to the sheet. Such LED lighting strips are known, and thus further not described herein in further detail. Each LED strip 78 runs along a respective portion of the outer perimeter of the rectangular Lexan sheet 48, for example covering half of two intersecting perimeter edges of the sheet from the respective corner of the sheet formed by these interesting edges. In such an embodiment, each LED strip centered at a respective corner of the sheet provides the substantial illumination of a respective quarter of the Lexan sheet 48. As a result of the multi-colored LED clusters 80, an LED controller 82 can be used to change the color of light emitted by the clusters of that strip, thereby changing the illumination color of the Lexan sheet at the respective quarter thereof. Accordingly, at any given moment, different areas of the Lexan sheet may be illuminated in different colors. Alternatively, a single LED strip 78 may extend continuously around the full perimeter of the illumination panel, with the LED clusters being controllable individually or in grouped sections allowing the same illumination of different areas of the sheet in different colors.

Figure 7:
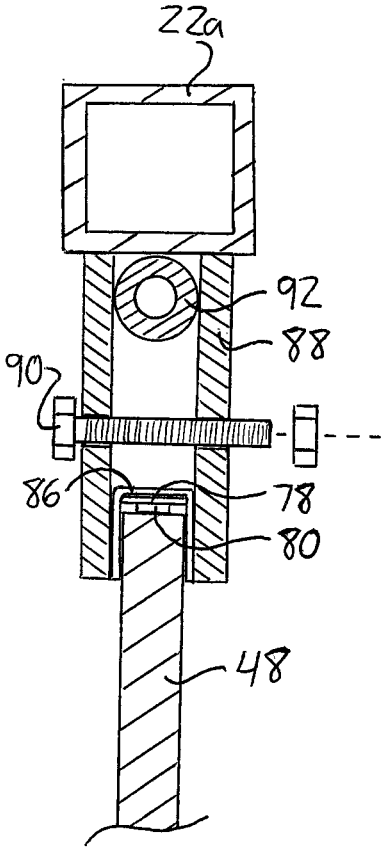
FIG. 7 is a schematic partial cross-sectional view of the scrolling display device, illustrating support of the illumination panel on a display frame of the device.

FIG. 7 illustrates how the illumination panel 48 and LED lighting strip 78 are supported on the base frame in one embodiment. The illumination panel is edge lit with the LED strip 78 that is taped to the edge of the illumination panel with a silver/reflective tape 86 that overlaps the edges of the LED strip to run onto the faces of the illumination panel sheet itself, for example by about ¼-inch onto the face from the perimeter edge thereof. The lead wires, (of which there is only one set in the case where a single continuous LED strip closes around the full perimeter of the illumination panel 48), may enter the hollow tubing of the display frame 20 by a drilled hole in a bottom corner thereof and run through the frame to a location where the control module 82 and batteries or AC/DC converter are housed, for example at a bottom of the unit.

The illumination panel 48 is held in the display frame 20 and supported with a gap, for example of approximately ½-inch, around the perimeter thereof so as to not crush the LEDs against the surrounding display frame 20. In the embodiment of FIG. 7, this is accomplished by using clamps 88 built out of clear rectangular Lexan pieces, (for example measuring about 3-inch×1.5-inch). The two pieces 88 of each clamp sandwich the full sheet illumination panel 48 at a respective location therearound (for example, there being a clamp in all corners of the display frame and at a mid-way location along each display frame member thereof) using a bolt 90, for example ⅝-inch bolt, that connects the two pieces 88 together. As these 'clamp' pieces 88 squeeze the illumination panel 48 at a perimeter edge thereof, they also squeeze against a piece of round stock 92 that is welded to the display frame 20 at a central position across the thickness thereof. Friction holds the clamps 88 to the Lexan sheet and they are locked in place by the round stock between them. To remove the illumination panel 48 if needed, the bolt 90 of each clamp 88 at the top and sides of the display frame are removed, and the bottom bolts/clamps are loosened, at which point the illumination panel can be slid out from between the lower clamp pieces 88 on a slight angle as to clear the top frame member 22*a*.

It will be appreciated that FIG. 7 demonstrates only one example of a manner in which the display panel may be supported, and other support arrangements may be used within the scope of the present invention.

The LED controller may be configured to illuminate different parts of the Lexan sheet in different colours to achieve unique lighting effects, for example using blue illumination at the top two LED strips to simulate the appearance of a clear daylight sky, or using a red or orange illumination to simulate a sunset visual over the top half of the panel while using a different color at the lower two LED strips. In another example, a green or yellow colour, or combination thereof, may be used together with imagery on the background web to simulate the appearance of vegetation in a prairie landscape. In another example, use of blue at the lower LED strips may be used to simulate the appearances of a body of water. The controller may be configured to switch back and forth between two colours to give a further vibrant effect, for example alternating between green and blue to give a 'water shimmering' effect, or between green and yellow to simulate a wind-blown crop or vegetation effect.

The control system preferably includes a suitable controller 84 to operate the motors 68, 70 according to a pre-programmed or user-programmable routine. For example, a single advertisement may employ only a single background frame by keeping the background web stationary, but scrolling the foreground web in order to change text matter or other foreground graphics, or to simulate an animated graphic moving across the stationary background graphic.

In one routine, the controller may be configured to run through multiple 'stationary background' ads or displays, where the first motor 68 is inactive for a predetermined run-time of that ad, while the second motor 70 is either run intermittently to periodically change the foreground graphic, or run continuously to simulate an animation effect between the stationary background and moving foreground superimposed thereover. Once the run-time has expired, the first and second motors 68 are then activated to scroll a new frame from the background web into the viewing window area of the device, along with a first foreground graphic for the new ad. In this context, a frame is referring to graphic content bordered by the viewing border at any given instant in time, and not necessarily to mean that graphic content of either web is limited to entirely distinct and separated graphics each sized to specifically fit within the viewing window.

In other examples, the foreground web may be kept stationary while using periodic or continuous movement of the background image to swap out background graphics or create a background animation effect. In one such instance, a long graphic showing a train-like image on the first web may exceed the width of the viewing window, and be slowly scrolled behind a stationary or intermittently changing foreground graphic. In yet a further example, other animation effects may be simulated with both webs being continuously scrolled at the same rate, where the background and foreground move together, or at different rates, where a moving foreground is effectively animated relative to the different scrolling speed of the background.

The LED and motor controllers are preferably linked, whether internally as integral parts of a same unit, or externally as separate modules connected together. This way, the control system can be configured to automatically effect changes in the backlighting in concert with changes to the background and/or foreground graphical display. Lighting changes may be made according to a change from one ad to another, or as part of an in-ad effect. Lighting changes include changing between overall illuminated and non-illuminated conditions of the illumination panel, changing an illuminated or non-illuminated state of only one or more partial portions of the panel, changing an overall color of the entire illumination panel, changing the color of only one or more partial portions of the overall panel, or changing all or part of the panel from a continuous or steady-state single color illumination to an alternating, sequentially switching/transitioning, or randomly switching/transitioning multi-color pattern.

Turning back to FIG. 1, a further illumination effect is achievable by illumination of the shells 74, 76 of the display border using additional light sources mounted in the hollow interior space bound by the shells, for example mounted on the frame members of the rectangular display frame 20 in orientations shining outward, or forward, or rearward and forward therefore. For such embodiments, the shells are made to be entirely translucent, or translucent at select areas of the shells. For example, in one embodiment, the shells are molded from Lexan polycarbonate, which is then given a surface treatment, such as sandblasting, to give the outer surfaces of the shells a degree of translucency less transparent than the original untreated Lexan shells. The surface treatment may be used to create semi-translucent/semi-opaque areas with a balance between obscuring the internal components of the display device from sight, while still allowing some degree of light-transmission through the shells for additional illumination effect to the overall display device, or may be used to make certain areas substantially or entirely opaque where concealment of inner components is needed, while leaving other areas in an original untreated state, or treating other areas to a level of reduced transparency that is less opaque than the substantially/fully opaque full-concealment areas.

It will be appreciated that advantageous features of the present invention may be used together, as described for the illustrated embodiment, or separately and independently of one another. For example, the beneficial use of background and foreground webs and a drive system operable to scroll one relative to the other can be employed regardless of whether the particular multi-colored, LED-based backlight panel and LED controller described herein are also used, or substituted by a more conventional backlight solution. Likewise, advantages of the described backlight solution may be employed for single-web scrolling displays. It will also be appreciated notable changes in the base frame or display frame may be made without sacrificing the beneficial aspects of other features detailed herein above. Similarly, the illuminated housing shell can be used regardless of whether the display uses a single scrolling web, multiple scrolling webs, or a stationary display, and regardless of the type of backlight solution employed.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A scroll type display device comprising:

a frame;

a pair of spools supported on the frame and spaced apart from one another;

a flexible web having graphics thereon and being entrained about the pair of spools to span therebetween for scrolling of said flexible web between said first pair of spools under rotation of at least one of said pair of spools;

a drive mechanism operable to drive rotation of said at least one of said pair of spools;

an illumination panel supported on the frame to underlie the span of the flexible web between the pair of spools, the illumination panel comprising a plurality of multi-color light sources each operable to emit different colors of light to change an illuminated state of the illumination panel;

a control system operable to control the multi-color light sources and the drive mechanism, the control mechanism being configured such that scrolling of flexible web from one position to another to change a display shown at the span of the flexible web between the spools corresponds to a respective automatic change in the illuminated state of the illumination panel.

2. The scroll type display device of claim 1 further comprising:

a second pair of spools supported on the frame and spaced apart from one another;

a flexible foreground web having foreground graphics thereon and being entrained about the second pair of spools for scrolling of said flexible foreground web between said second pair of spools in a position overlying the span of the flexible web between the pair of spools under rotation of at least one of said second pair of spools; and a second drive mechanism operable to drive rotation of said at least one of said second pair of spools.

3. The scroll type display device of claim 1 wherein the frame comprises a display border delimiting a viewing window through which the flexible web is viewable, and the pair of spools are spaced apart across said viewing window so that the flexible web spans fully across said viewing window.

4. The scroll type display device of claim 3 wherein the display border comprises at least one translucent portion, and there is provided an illumination source positioned on the frame to illuminate said translucent portion of the viewing border.

5. The scroll type display device of claim 3 wherein the illumination panel spans an area of the viewing window, and the frame further comprises an auxiliary window positioned opposite the viewing window and through which the light from the illumination panel is visible.

6. The scroll type display device of claim 5 wherein the display border comprises front and rear shells coupled together with a hollow space therebetween in which the scrolls and the drive mechanism are supported, wherein the front shell defines the viewing window and the rear shell defines the auxiliary window.

7. The scroll type display device of claim 1 wherein the illumination panel comprises an edge-lit panel and the plurality of multi-color light sources are disposed around a perimeter of said edge-lit panel to emit light into said panel from perimeter edges thereof.

8. The scroll type display device of claim 7 wherein said plurality of multi-color light sources comprise LED light sources.

9. The scroll type display device of claim 7 wherein the multi-color light sources comprise LED strips spanning different portions of the perimeter of the edge-lit panel.

10. The scroll type display device of claim 1 wherein the control system is operable to control said multi-color light sources in a manner simultaneously illuminating different areas of the illumination panel in different colors.

11. The scroll type display device of claim 1 wherein the control system is operable to flip at least one of said multi-color light sources back and forth between two different colors.

12. A scroll type display device comprising:

a frame;

a pair of spools supported on the frame and spaced apart from one another;

a flexible web having graphics thereon and being entrained about the pair of spools to span therebetween for scrolling of said flexible web between said first pair of spools under rotation of at least one of said pair of spools;

a drive mechanism operable to drive rotation of said at least one of said pair of spools;

an illumination panel supported on the frame to underlie the span of the flexible web between the pair of spools, the illumination panel comprising a plurality of multi-color light sources distributed at different positions to illuminate different portions of said illumination panel; and an illumination controller operable to vary an illumination pattern of the illumination panel by switching a color of light at one or more said different positions; and a drive controller linked to the illumination controller and operable to control the drive mechanism;

wherein the controllers are arranged so that scrolling of flexible web from one position to another to change a display shown at the span of the flexible web between the spools corresponds to a respective automatic change of the illumination pattern of the illumination panel.

* * * * *